US007251896B2

(12) United States Patent
Khubani

(10) Patent No.: US 7,251,896 B2
(45) Date of Patent: Aug. 7, 2007

(54) HAIR CLIPPER WITH PIVOT HEAD

(75) Inventor: Anand Khubani, Towaco, NJ (US)

(73) Assignee: Ideavillage Products Corp., Fairfield, NJ (US)

( * ) Notice: Subject to any disclaimer, the term of this patent is extended or adjusted under 35 U.S.C. 154(b) by 410 days.

(21) Appl. No.: 10/940,270

(22) Filed: Sep. 14, 2004

(65) Prior Publication Data

US 2006/0053632 A1 Mar. 16, 2006

(51) Int. Cl.
*B26B 19/04* (2006.01)

(52) U.S. Cl. ..... 30/199; 30/210; 74/44; 74/49

(58) Field of Classification Search ..... 30/199, 30/210, 527, 208, 211; 74/44, 49
See application file for complete search history.

(56) References Cited

U.S. PATENT DOCUMENTS

| | | | | |
|---|---|---|---|---|
| 1,059,774 | A | 4/1913 | Sharpneck | |
| 2,222,317 | A | 11/1940 | Martin | |
| 2,630,148 | A | 3/1953 | Ferguson | |
| 3,160,902 | A | 12/1964 | Aymar | |
| 3,513,544 | A * | 5/1970 | Renger | 30/277.4 |
| 3,802,073 | A | 4/1974 | Braun et al. | |
| 4,400,875 | A | 8/1983 | Buzzi et al. | |
| 4,879,935 | A * | 11/1989 | Gerber | 83/748 |
| 5,033,150 | A | 7/1991 | Gross et al. | |
| 5,165,172 | A * | 11/1992 | Weinrauch | 30/199 |
| 5,611,804 | A | 3/1997 | Heintke et al. | |
| 5,940,977 | A | 8/1999 | Moores, Jr. | |
| 6,098,288 | A | 8/2000 | Miyagawa et al. | |
| 6,264,211 | B1 | 7/2001 | Granado | |
| 6,277,129 | B1 | 8/2001 | Poran | |
| 6,671,969 | B2 * | 1/2004 | Phillips et al. | 30/377 |
| 2003/0221319 | A1 | 12/2003 | Iwashita et al. | |

* cited by examiner

*Primary Examiner*—Boyer D. Ashley
*Assistant Examiner*—Carolyn T Blake
(74) *Attorney, Agent, or Firm*—Robert L. Epstein; Epstein Drangel Bazerman & James, LLP

(57) ABSTRACT

The clipper has a cylindrical housing including a handle containing a battery and motor and a head pivotally mounted on the handle. The head carries a stationary blade and a reciprocating blade. Motion is transmitted from the motor to the reciprocating blade through a flexible rod. One end of the rod is connected to a protrusion offset from the axis of a gear connected to the output shaft on the motor. The other end of the arm carries the reciprocating blade. A control button is provided on the head. The control button can be manipulated to disengage the handle, to permit the head to be pivoted relative to the handle.

7 Claims, 4 Drawing Sheets

HAIR CLIPPER WITH PIVOT HEAD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER Program Listing Appendix Submitted on Compact Disc Not Applicable

BACKGROUND OF THE INVENTION

1. Field of the Invention

The present invention relates to a lightweight, portable electric hair clipper and more particularly to such a hair clipper in which the head section is mounted on the handle section such that it can be pivoted relative to the handle section.

2. Description of Prior Art Including Information Disclosed Under 37 CFR 1.97 and 1.98

Many types of electrically driven hair cutting instruments including stationary blade elements and movable blade elements are known. Those hair cutters can be broadly characterized into those in which the moveable blade elements reciprocate relative to the stationary blade element in a direction perpendicular to the axis of the device, such as those disclosed in U.S. Pat. Nos. 2,222,317, 4,400,875 and 5,611,804, and those in which the moveable blade elements reciprocate in a direction parallel to the axis of the device, such as those disclosed in U.S. Pat. Nos. 1,059,774, 5,165,172 and 6,098,288. This invention relates to a hair clipper in the latter type.

There are also many other types of devices in which reciprocating motion of an element in a direction parallel to the axis of the device is employed. Those devices include electric toothbrushes, such as those disclosed in U.S. Pat. No. 5,033,150, and electric saws with reciprocating blades, such as those disclosed in U.S. Pat. Nos. 2,630,148, 5,940,977 and 6,264,211.

Of the types of devices with pivot heads, where the reciprocating motion is along the axis device, there is U.S. Pat. No. 5,165,172 to Weinrauch, that relating to a hair clipper with a pivot head and U.S. Pat. No. 5,940,977 to Moores, relating a saw blade mounted on a head that is capable of pivoting relative to the handle portion.

Devices in which the head that is capable of pivoting relative to the handle require a drive mechanism that is capable of transmitting motion from the drive motor, located in the handle, to the reciprocating blade elements, located in the head, whether the head is situated in a pivoted or non-pivoted position. Both the Weinrauch hair clipper and the Moores saw incorporate such motion transmission mechanisms.

However, the Weinrauch transmission mechanism employes a multiple gear system that is far too complex and expensive for use in a small, inexpensive hand-held hair clipper of the type involved here. The Moores transmission mechanism requires a rigid transmission arm for transferring the large amount of power necessary for a reciprocating saw to cut through the type of materials for which the saw is intended. Such a transmission mechanism is much too costly and heavy duty for an inexpensive, portable, light weight hair clipper of the type to which the present invention pertains.

It is, therefore, a prime object of the present invention to provide a hair clipper with a pivot head that is light in weight, portable, mechanically simple and inexpensive.

It is another object of the present invention to provide a hair clipper with a pivot head that includes a simple power transmission mechanism incorporating a flexible transmission rod.

It is another object of the present invention to provide a hair clipper with a pivot head that includes a handle section with oppositely directed outstanding bosses and a head section having flexible arms with boss receiving recesses adapted to receive the handle section, with the bosses situated in the recesses.

It is another object of the present invention to provide a hair clipper with a pivot head having a control button that is actuated to permit the head section to be pivoted relative to the handle section.

BRIEF SUMMARY OF THE INVENTION

In accordance with the present invention, a hair clipper is provided. The hair clipper has a generally cylindrical housing including a handle section, a head section and means for pivotally connecting the head section and the handle section. The handle section is adapted to receive a battery and a motor, connected to the battery, having a rotatable output shaft. A first gear is mounted on the motor output shaft. A second gear is situated in engagement with the first gear. The second gear is mounted in the forward portion of the handle section for rotation, about an axis, relative to the handle section. An upstanding protrusion is provided on the surface of the second gear, at a point spaced from the axis of the second gear. The head section carries clipper means. The clipper means includes a stationary blade element and a reciprocating blade element. The connecting means includes first and second outstanding pivot bosses mounted on opposite sides of the forward portion of the handle section. The head section includes first and second spaced arms. Each of the arms has a pivot boss receiving recess. The arms are formed of flexible material and are adapted to flex to receive the forward portion of the handle section therebetween, with the bosses on the handle section situated in the boss receiving recesses of the head section arms. Motion transmission means is provided. The motion transmission means includes a flexible drive rod. The drive rod has a first end defining an opening adapted to receive the protrusion on the surface of the second gear. The second end of the drive rod is connected to the reciprocating blade element.

Each of the outstanding bosses defines a recess. First and second rivets are adapted to be received in the boss recesses, respectively.

A pivot control button is provided. The button is movable to permit the head section to be pivoted relative to the handle section.

Means, associated with the control button, are mounted for movement between a first position, wherein the forward portion of the handle section is engaged to prevent the head section from pivoting relative to the handle section and a second position, wherein the forward portion of the handle section is disengaged such that it can be pivoted relative to the handle section.

The bosses define an axis about which the head section can pivot. Preferably, the bosses are situated along the axis of rotation of the second gear.

BRIEF DESCRIPTION OF THE SEVERAL VIEWS OF DRAWINGS

To those and to such other objects that may hereinafter appear, the present invention relates to a hair clipper with a pivot head, as described in detail in the following specification and recited in the annexed claims, taken together with the accompanying drawings wherein like numbers refer to like parts, and in which:

DETAILED DESCRIPTION OF THE INVENTION

Figure 1:
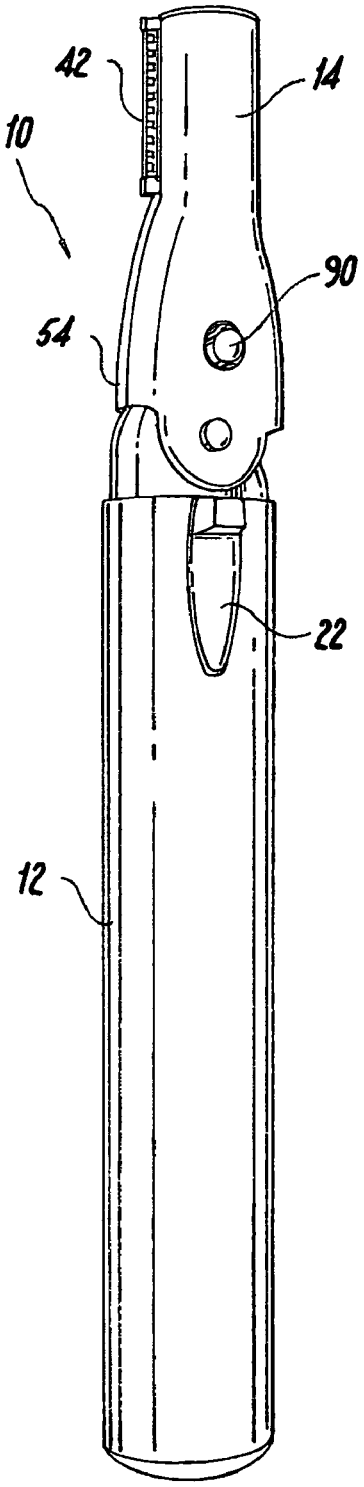
FIG. 1 is a side elevation view of the hair clipper of the present invention with the head section in the non-pivoted position.
Figure 2:
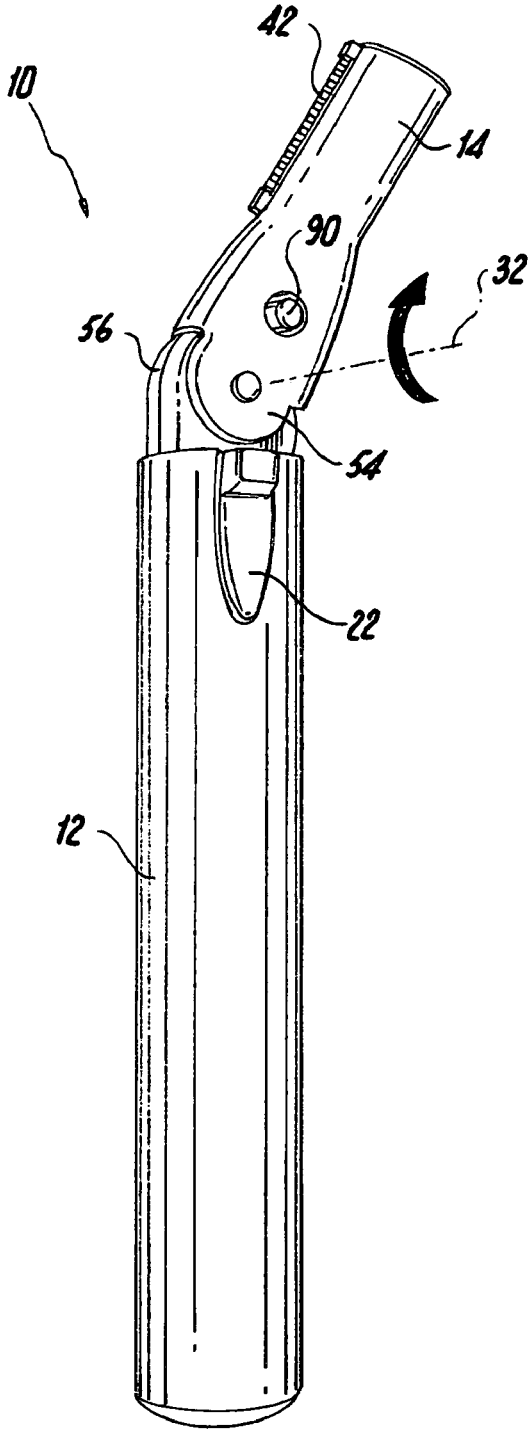
FIG. 2 is a side elevation view of the hair clipper of the present invention with the head in the pivoted position.
Figure 3:
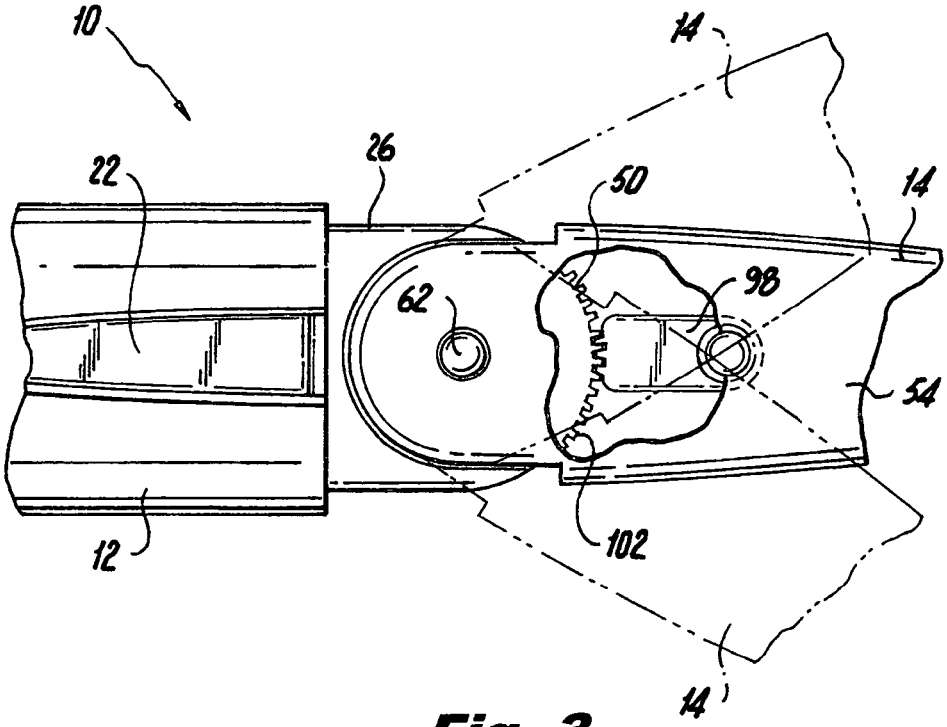
FIG. 3 is a cross-sectional view of the forward portion of the handle section and the rear portion of the head section showing the control button in the engaged position.

As seen in the drawings, the hair clipper of the present invention includes a generally cylindrical housing 10 made of lightweight metal or plastic material. Housing 10 includes a handle section 12 and a head section 14.

Handle section 12 is hollow and includes a recess 16 into which a battery (not shown) and a motor 20 are received. The battery is connected to motor 20 through a slide-type power switch 22 accessible from the exterior of the handle section 12 of housing 10.

Figure 4:
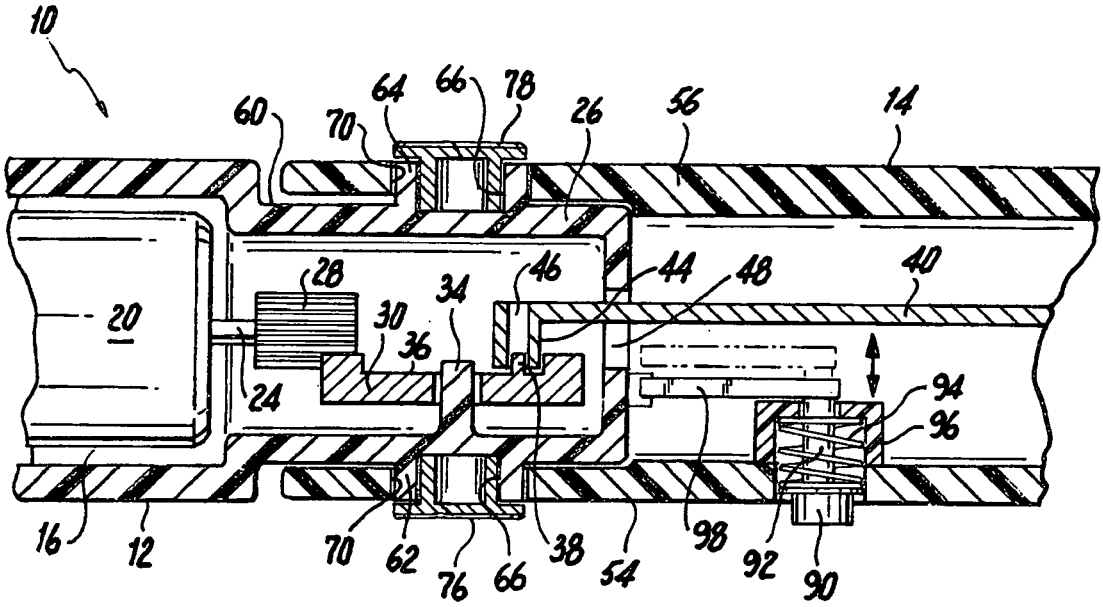
FIG. 4 is a cross-sectional view of the forward portion of the handle section and the rear potion of the head section showing the drive mechanism and the control button.
Figure 7:
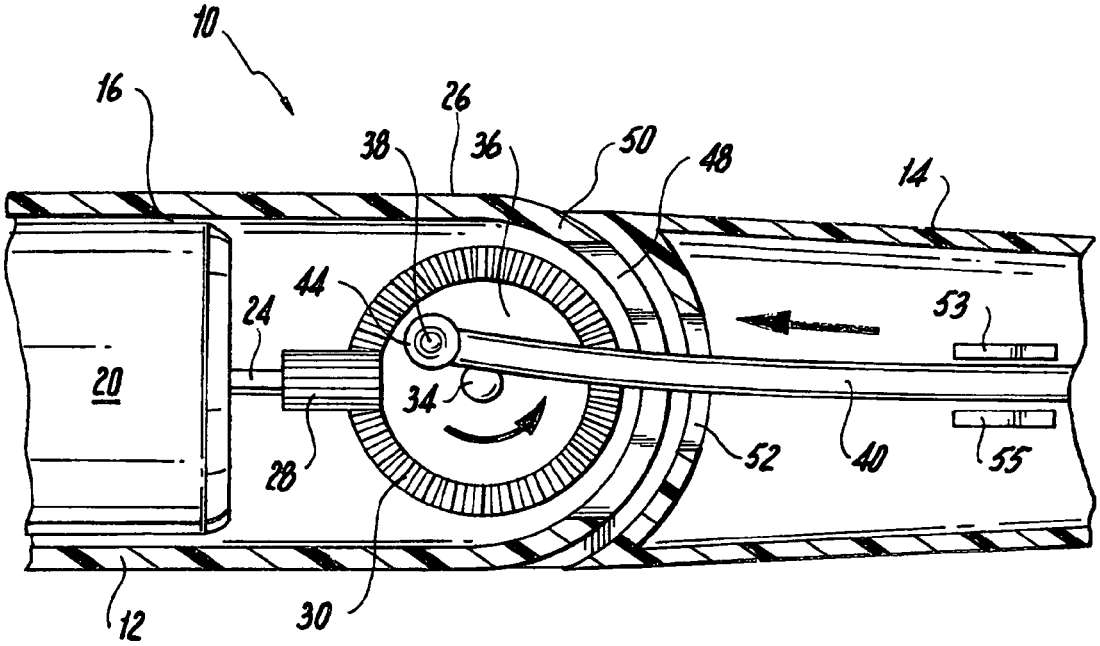
FIG. 7 is a cross-sectional view of the motion transfer mechanism showing the transmission rod in its rearward position.
Figure 8:
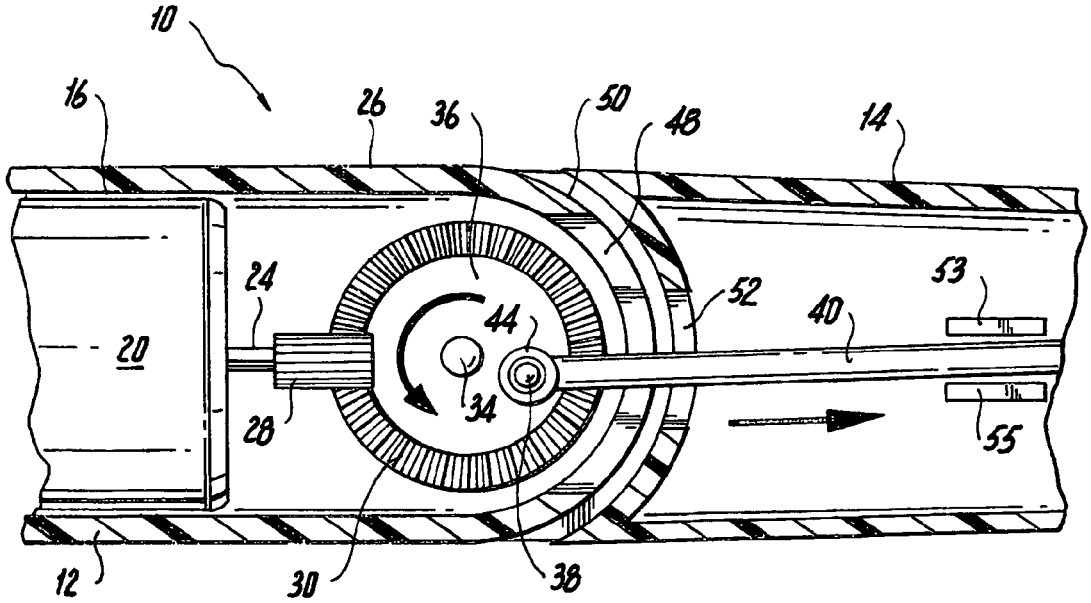
FIG. 8 is a cross-sectional view of the motion transfer mechanism showing the transmission rod in its forward position.

As is best seen in FIGS. 4, 7 and 8, motor 20 has a rotatable output shaft 24 that extends into the forward portion 26 of handle section 12 along the axis of housing 10. A first drive gear 28 is fixedly mounted on the end of shaft 24.

The teeth of a second drive gear 30 mesh with the teeth of the first drive gear 28. The second drive gear 30 is mounted within forward portion 26 for rotation about an axis 32, defined by a shaft 34 which extends from the interior wall of forward portion 26. Gear 30 has a surface 36 with a protrusion 38. Protrusion 38 is offset from shaft 34, and hence axis of rotation 32 of gear 30, by a short distance.

A transmission rod 40 is connected between protrusion 38 of second device gear 30 and the reciprocating blade element 42 in head section 14. One end of rod 40 is provided with a hollow cylindrical portion 44. Portion 44 has a channel 46. Channel 46 is adapted to receive protrusion 38 in a rotatable fashion. Because protrusion 38 is offset from the axis of rotation of second drive gear 30, the rotation of gear 30 causes rod 40 to reciprocate, as seen by comparing FIGS. 7 and 8. Rod 40 is formed of flexible material, such as metal or plastic, such that it can flex along its length to accommodate the pivot head section 14 and transfer regardless of the position of the head section. Rod 40 extends through an opening 48 in the arcuate surface 50 of forward portion 26 of the handle section 12. Rod 40 also extends through an opening 52 in the portion of head section 14.

Extending from the interior wall of head section 14 are a pair of upstanding spaced guides 53, 55. Rod 40 passes between guides 53, 55, as seen in FIGS. 7 and 8. Guides 53, 55 maintain the forward end of rod 40 in line with the reciprocating blade element 42, regardless of the pivotal position of the head section relative to the handle section.

Figure 5:
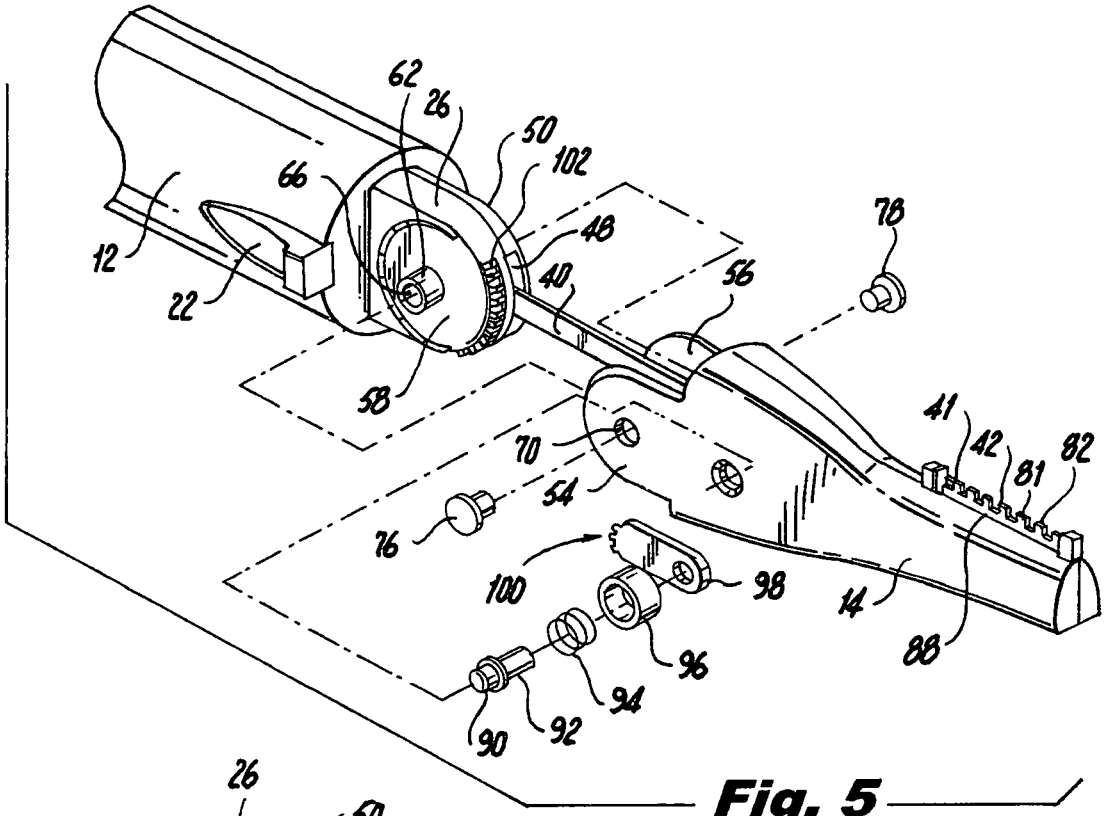
FIG. 5 is an exploded view of the forward portion of the handle portion and the head section.

As best seen in FIG. 5, the rear portion of head section 14 carries spaced, rearwardly extending arms 54, 56. Extending outwardly from opposite generally flat sides 58, 60 of forward portion 26 of the handle section are a pair of raised cylindrical bosses 62, 64. Each boss 62, 64 defines a recess 66, 68, respectively.

Each of the arms 54,56 is provided with a boss receiving opening 70, 72, respectively. Arms 54, 56 are made of material, such as metal or plastic, that permits them to flex sufficiently to receive forward portion 26 therebetween, with bosses 62, 64 situated within recesses 66, 68 respectively. In this manner, head section 14 is mechanically connected to handle section 12 such that it can be pivoted relative to handle section 12, about an axis 74, defined by bosses 62, 64.

Rivets 76, 78 are received in openings 70, 72 of bosses 62, 64, respectively. Rivets 76, 78 have enlarged heads and shafts that are "press-fitted" into openings 70, 72 so as to retain arms 54, 56 in place on forward portion 26, as head section 14 pivots relative to handle section 12.

A control button is provided to "lock" head section 14 in position relative to handle section 12. The button is mounted in the wall of head section 14 and includes a head 90 mounted on shaft 92. Head 90 is accessible from the exterior of the head section. Shaft 92 is received within a helical compression spring 94. Spring 94 is located within a sleeve 96 such that shaft 92 is moveable from an outer position, shown in phantom in FIG. 4, against the urging of spring 94, to an inner position, shown in solid in FIG. 4.

Figure 6:
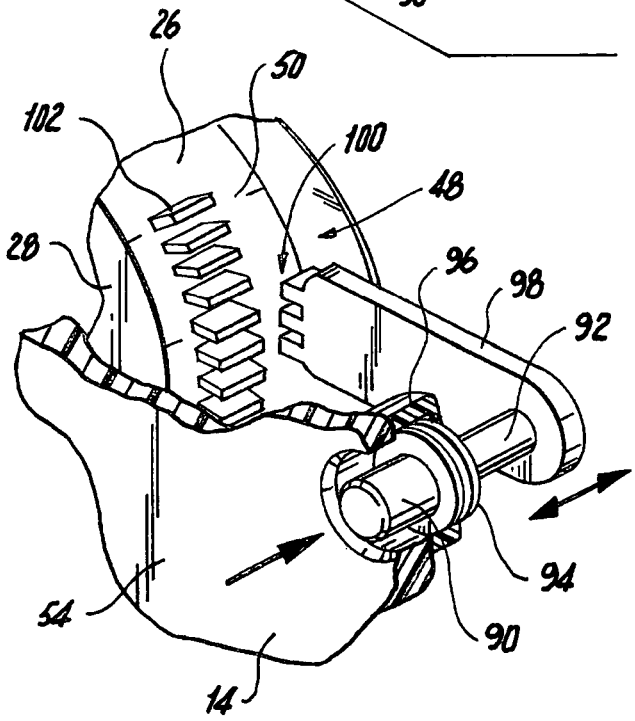
FIG. 6 is an isometric cutaway view showing the control button and a portion of the forward portion of the handle section.

As best seen in FIG. 6, part 98, fixed to the end of shaft 92, has a plurality of gear teeth 100 at its rear edge. Teeth 100 are adapted to mesh with gear teeth 102 situated on the arcuate surface 50 of forward portion 26 of handle section 12 when shaft 92 is in the outer position. When teeth 100 engage teeth 102, head portion 14 cannot be pivoted relative to handle portion 14, as it is "locked" into position.

When button head 90 is depressed, against the action of spring 94, shaft 92 and thus part 98 are moved toward the inner position, causing teeth 100 to disengage teeth 102, thereby permitting head section 14 to be pivoted about axis 32 relative to handle section 12. When the desired pivot angle is reached, button head 90 is released, spring 94 moves shaft 92 and part 98 back to the outer position, locking the head section at the desired pivot angle relative to the handle section.

Head section 14 has an elongated stationary blade element 41 with set of teeth 82. Mounted on the end of drive rod 40 opposite from portion 44 is a reciprocating blade element 42 with a set of teeth 86. Element 42 extends through a slot 88 in head section 14 adjacent blade element 41 such that as gear 30 rotates, blade element 42 is reciprocated alongside stationary blade element 41. Because of the structure transmission mechanism, and the flexibility of the transmission rod, the reciprocation of blade element 42 takes place whether the head section 14 is aligned with the handle section 12 or is pivoted relative to the handle section, about axis 32.

It should now be appreciated that the present invention relates to am inexpensive, lightweight portable hair clipper with a pivot head. The clipper has a cylindrical housing with a handle section containing a battery and a motor. The output shaft of the motor extends into the forward portion of the handle section which encloses a gear assembly connected to the reciprocating blade element in the head section by a flexible transmission rod.

While only a single preferred embodiment of the present invention has been disclosed for purposes of illustration, it is obvious that many variations and modifications could be made thereto. It is intended to cover all of those variations and modifications that fall within the scope of the present invention, as set forth in the following claims:

I claim:

1. A hair clipper comprising a generally cylindrical housing comprising a handle section having a forward portion, a head section and means for pivotally connecting said handle and head sections, said handle section being adapted to receive a battery and a motor connected to said battery, said motor having a rotatable output shaft, a first gear mounted on said output shaft, a second gear in engagement with said first gear, said second gear being mounted in the forward portion of said handle section for rotation, about an axis, and having a surface, an upstanding protrusion on said second gear surface located at a point spaced from said axis of rotation of said second gear, said head section comprising blade means, said blade means comprising a stationary blade element and a reciprocating blade element, said means for pivotally connecting said handle and head sections comprising first and second outstanding pivot bosses mounted on opposite sides of said forward portion of said handle section, said head section comprising first and second spaced arms, each of said arms comprising a pivot boss receiving recess, said arms being formed of flexible material and being adapted to receive the forward portion of said handle section therebetween, with said bosses in said boss receiving recesses, and motion transmission means comprising a flexible reciprocating drive rod, said drive rod having a first end defining an opening adapted to receive said protrusion and a second end connected to said reciprocating blade element.

2. The clipper of claim 1 wherein each of said bosses defines a recess.

3. The clipper of claim 2 further comprising first and second rivets adapted to be received in said boss recesses, respectively.

4. The clipper of claim 1 further comprising a control button, said button being moveable to permit said head section to be pivoted relative to said handle section.

5. The clipper of claim 4 further comprising means associated with said control button, said means being mounted for movement between a first position, wherein said forward portion of said handle section is engaged to prevent said head section from pivoting relative to said handle section and a second position, wherein said forward portion of said handle section is disengaged such that said head section can be pivoted relative to said handle section.

6. The clipper of claim 1 wherein said bosses define an axis about which said head section pivots.

7. The clipper of claim 1 wherein said bosses are situated along the axis of rotation of said second gear.

* * * * *